US005913261A

United States Patent [19]

Guhring et al.

[11] Patent Number: 5,913,261

[45] Date of Patent: Jun. 15, 1999

[54] TRIGGER ARRANGEMENT

[75] Inventors: Manfred Guhring, Oberndorf; Helmut Danner, Sulz-Sigmarswangen, both of Germany

[73] Assignee: Heckler & Koch GmbH, Germany

[21] Appl. No.: 08/885,365

[22] Filed: Jun. 30, 1997

[30] Foreign Application Priority Data

Jun. 28, 1996 [DE] Germany ..... 196 26 077

[51] Int. Cl.[6] ..... F41A 19/33

[52] U.S. Cl. ..... 89/128; 89/141; 89/142; 89/144; 89/148; 89/151; 89/154; 42/69.03

[58] Field of Search ..... 89/128, 144, 148, 89/149, 151, 154, 141, 142; 42/69.03

[56] References Cited

U.S. PATENT DOCUMENTS

| | | | |
|---|---|---|---|
| 720,698 | 2/1903 | Johnson | 89/148 |
| 3,029,708 | 4/1962 | Marchisio | 42/69.03 |
| 3,167,877 | 2/1965 | Jungeling | 42/69.03 |
| 3,197,906 | 8/1965 | Elkas et al. | 42/69.03 |
| 3,251,268 | 5/1966 | Menneking | 89/149 |
| 3,618,455 | 11/1971 | Plumer et al. | 89/149 |

FOREIGN PATENT DOCUMENTS

| | | | |
|---|---|---|---|
| 18 90 933 | 4/1964 | Germany . | |
| 14 53 913 | 7/1969 | Germany . | |
| 31 20 128 | 12/1982 | Germany . | |
| 440045 | 12/1967 | Switzerland | 89/149 |

*Primary Examiner*—Stephen M. Johnson
*Attorney, Agent, or Firm*—Leydig, Voit & Mayer, Ltd.

[57] ABSTRACT

A trigger arrangement for an automatic weapon with switch-over between continuous firing and single-shot modes includes a hammer, a breechblock, a latch, a pivotably mounted trigger, and a firing lever. In the single-shot mode, the firing lever engages the hammer and retains it in tension while the trigger is depressed. When the continuous firing mode is selected, the firing lever is moved to an inactive position and retained by an engaging element. The engaging element is preferably a slider which is controlled by a safety and firing cessation roller that is actuated by an operating lever.

19 Claims, 3 Drawing Sheets

TRIGGER ARRANGEMENT

FIELD OF THE INVENTION

The invention relates generally to the weaponry art, and more particularly to a trigger arrangement for an automatic weapon with shift-over mechanism to place the weapon in various firing modes.

BACKGROUND OF THE INVENTION

Various trigger arrangements are known in the art. For example, a relatively simple trigger mechanism comprises an impact piece or hammer retentively held under the tension of a percussion spring. The impact piece is held by engagement with a stop and is released by actuation of a trigger. A safety device is used to prevent movement of one of the functioning elements of this trigger arrangement although this feature renders the mechanism somewhat more complicated.

Automatic weapons designed for selective operation in a single-firing mode further include an interrupter disposed to decouple the connection between the trigger and the impact piece, or hammer, immediately after a shot is fired. That is, they perform the interrupt function when the trigger is still active from the past shot but the weapon is already again ready to fire.

Coiling automatic weapons have also been designed for continuous firing. These weapons provide for automatic release of the impact piece as long as the trigger remains activated in continuous firing position. Such a mechanism is likewise relatively complicated.

In another example, a G3 rifle trigger arrangement comprises a hammer, a movable breechblock, a latch, a trigger, and a firing lever. The hammer has first and second stop notches and is movable between a relaxed position and a fully tensioned position. The breechblock is a movable breechblock. During its recoil, the breechblock moves the hammer from its relaxed position to the fully tensioned position. The latch is urged by a latch spring against the hammer. In this position, the latch engages the first hammer stop notch and retains it in a first tension position, which lies near the fully tensioned position. The latch also has a protrusion which engages the breechblock in such a manner that, in the ready-to-fire position, the latch is moved against the action of the latch spring and disengages the first stop.

The trigger is pivotally mounted and has an engagement lug disposed thereon. The trigger is normally urged by a trigger spring into a front rest position. Actuation of the trigger urges the spring from this rest position into a released position. The firing lever is rotatably mounted and movable in a longitudinal direction between a front and rear position. A spring arrangement normally biases the lever toward the front position as well as in a turning direction, which is counter to the swing travel of the trigger when actuated. The firing lever has an extension at an end which engages the second hammer stop notch to retain the hammer in a second tension position. This position is further remote in rotation than the first tension position. When the trigger is pulled rearward, the engagement lug disengages the lever from the second stop notch. Upon release of the lever from the second stop notch, the lever is in a position, by action of the spring arrangement, to be forwardly moved out of the action zone of the engagement lug. The lever again passes into engagement with the second stop notch. A shift-over arrangement is typically employed during continuous firing to prevent engagement of the firing lever with the second stop notch. Thus, the latch only acts on the hammer and this is freed again each time if the breechblock is closed.

In addition to being as functionally secure and durable as possible, trigger arrangements should have relatively few parts. Moreover, trigger arrangements should also be insensitive to deficient care, fouling, and harsh conditions. Trigger arrangements should also be as light as possible and their individual parts should be simple and economically manufacturable.

In the case of a rapid-fire rifle, in which the trigger arrangement is located in a pistol grip, there is the further difficulty that some functional elements cannot have multiple uses, as with automatic pistols where the closing spring can be used simultaneously as the trigger spring. Moreover, trigger arrangements for rapid firing rifles which allow selection between continuous firing and single firing and which are equipped with a safety feature are typically so complex that their construction requires undue time. Slight variations in one component create unexpected and undesired interactions.

The known trigger arrangement of the G3 rifle is functionally secure and insensitive to fouling. Also, as compared with other known trigger arrangements, it is simple in construction, as it uses only wire springs, and it is relatively economical to produce. However, the known G3 rifle trigger arrangement suffers several disadvantages. In the single firing mode, the firing lever is rotated by moving the trigger. In the process, the firing lever disengages the second stop notch so that the hammer strikes off. In the following shot, the firing lever is pressed forward by springs and its rear end is freed from the engagement lug. The lever may be rotated in the opposite direction by another spring so that its front end tends to catch the second stop notch. The hammer is tensioned during the breechblock movement and held in position by the latch until the latch is swung by the breechblock to free the first stop notch. The hammer second stop notch falls into the aforementioned extension and in so doing presses the lever to the rear against the force of a spring. If the trigger is released, it swings forward and in the process is lowered, together with the engagement lug, until the lug grips the trigger lever. This rotates the lever after being thrust rearward by the second stop post of the hammer. When the trigger is pulled again, the lever is again rotated which, in turn, releases the second stop post, so that the described would process take place again.

In order to be able to deliver continuous firing, the trigger must be pulled further in order to sufficiently swing the firing lever away from the movement zone of the second hammer stop notch. The hammer is retained by the latch only and it strikes off as soon as the breechblock is closed.

A shot should occur at the same angular position of the trigger in either single firing mode or a continuous firing mode. However, in the case of continuous firing, the trigger must be pulled back further in order to prevent the firing lever and the hammer from engaging one another. If the mobility of the index finger of the rifleman is impaired, then it is possible that, in continuous firing, the trigger is not swung far enough. In that case, instead of a burst, only a single shot is delivered.

SUMMARY OF THE INVENTION

Accordingly, it is a general object of the invention to overcome the deficiencies of the prior art.

It is a further object of the invention to develop known trigger arrangements to improve dependability.

It is a more specific object of the invention to provide a trigger path through which the trigger must be swung for either individual or continuous firing to be substantially the same path.

It is yet another object of the invention to provide reduced weight in a trigger arrangement, while providing simplified production and reduced cost.

These and other objects and advantages are achieved in a trigger arrangement comprising shift-over mechanism with an engagement element which can be brought into engagement with the firing lever to prevent forward movement thereof. In the continuous firing mode, the firing lever is not, as in the prior art, brought out of engagement with the hammer by rotating movement. Rather, the engaging element prevents the firing lever from forward movement in order to effectively act as an interrupter. Accordingly, the position of the trigger is the same as in single-shot firing. This eliminates the above-described disadvantages. In addition, it restricts further movement of the trigger after releasing of the shot (so-called "Trigger-Stop") so that the accuracy of the rifle can be improved.

DETAILED DESCRIPTION OF THE PREFERRED EMBODIMENTS

Generally, the invention relates to a trigger arrangement that includes a retaining mechanism to maintain the firing lever in a desired mode. The invention is implemented as an improvement of a known construction now used in a G3 rifle. This leads to improved operation without the above-explained deficiencies. However, the invention is intended to be used in any rifle, such as a stroking-up rapid-fire pistol, sub-machine gun or stroking-up machine gun.

In the specification, it should be understood that certain position designations such as "above", "forward", etc. are made with reference to a weapon which is in a normal use position with a bore axis (or barrel central axis) horizontally disposed. "Forward" and "rearward" are used relative to the firing direction.

Figure 1:
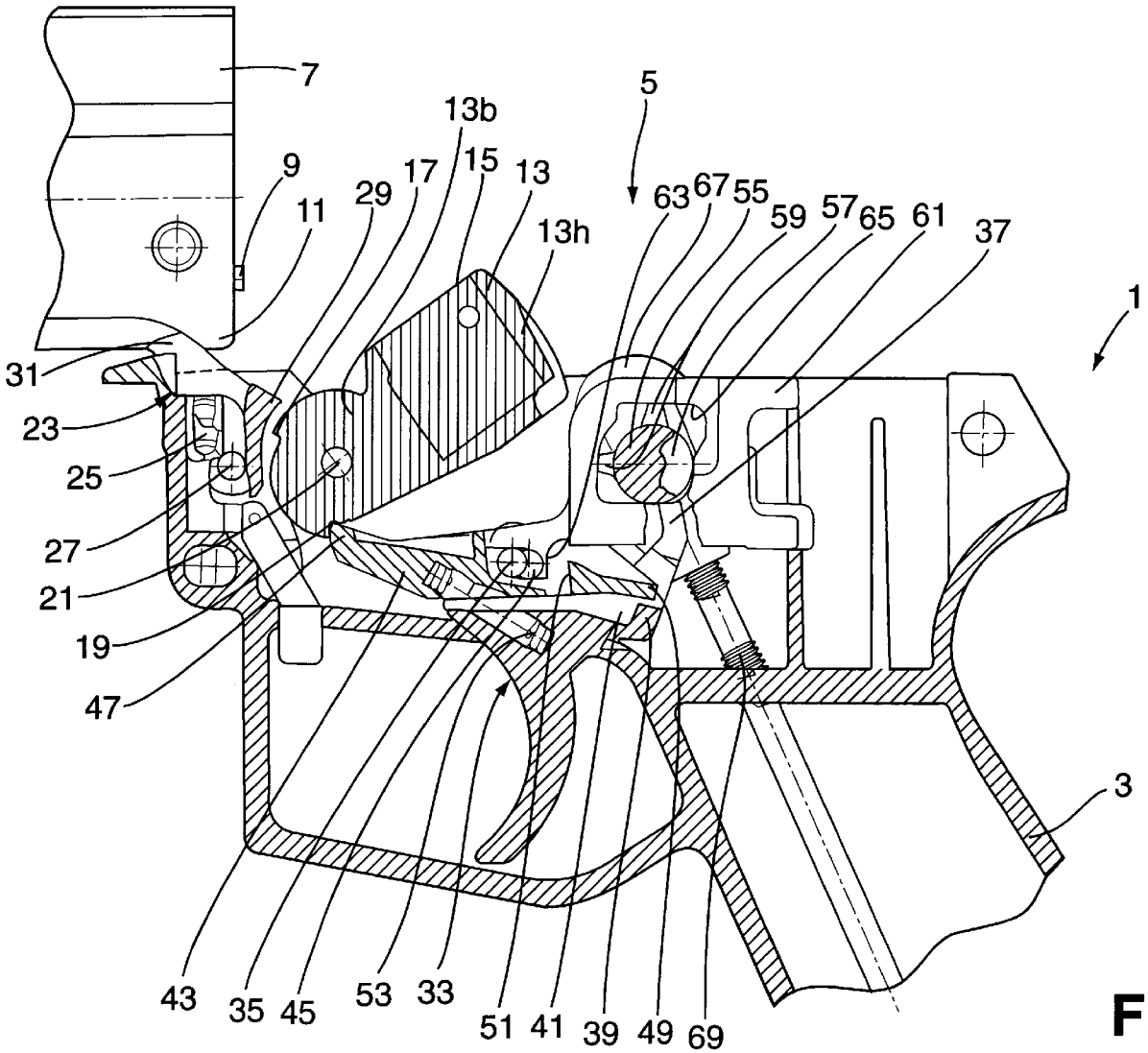
FIG. 1 is a longitudinal section through a weapon illustrating a trigger arrangement according to the invention.

FIG. 1 shows a grip piece 1 preferably fabricated of pressure-cast, plastic. The upper part of the grip piece is formed by a case which is substantially closed on all sides and on the underside of which there is molded a grip 3. A trigger arrangement 5 according to the invention is seated in the interior of the case.

The grip piece 1 is mounted to the underside of a rifle housing (not shown) with the use of a pair of cross bolts (not shown). A breechblock 7 is movably disposed in the rifle housing such that after a shot is fired, or upon actuation of a handle, it moves from a forward or front end position shown, in which the rifle is ready to fire to a rearward position by traversing over the grip piece 1 and then forward again. A groove is formed on the underside of the breechblock 7 extending in its longitudinal direction. The rear side of the groove is blocked by an interrupter projection 11 formed on the breechblock 7. A firing pin 9 protrudes from the rear, vertical surface of the breechblock 7. When struck by a hammer 13, the firing pin is thrust forward to engage a cartridge disposed in the firing chamber as will be understood by those skilled in the art.

A latch 23 is rotatably mounted to a latch shaft 27 beneath the interrupter projection 11. Latch 23 is also preferably fabricated of plastic and has a finger protrusion 31 disposed at one end which extends from the latch shaft 27, into the groove of the breechblock 7. The protrusion 31 is biased upwardly by a latch spring 25. When the breechblock 7 is located at the front end position shown, the interrupter projection 11 applies a downward force to the latch protrusion 31 and urges it forward.

The latch 23 also comprises a latch stop projection 29 disposed opposite to the finger protrusion 31 and above the latch shaft 27. In the position shown, the interrupter projection 11 of the breechblock urges the latch 23 forward to thereby move the latch stop projection 31 forward.

According to one feature of the invention, a novel percussion spring arrangement is utilized. The percussion spring arrangement is formed by a pair of wire-shank springs, each of which resembles a clothespin spring with opposed, outwardly extending shanks coupled with a central wound or spiral section. Each of the spiral sections is seated on a hammer shaft stub formed on the hammer and coaxial with a hammer axis of rotation. One of the shank pairs is supported on a lateral projection of the hammer. The opposed or free shank pair is supported on the corresponding projections in the interior of the plastic grip piece. Each of the projections is burdened with only half of the total spring force. Furthermore, this burden can be reduced by selecting the shank so that the fatigue strength of the hammer and grip piece are not exceeded. The shank pair facing one also another can be connected by a crossbar that lies against the hammer. The force of the two springs is distributed and reduced so that the hammer is dependably driven without a force being applied up on various plastic parts which exceed their strength.

The hammer 13 comprises a head portion **13*h* and an arcuate-shaped body portion 13*b*. The hammer body portion 13*b* is rotatably mounted to a hammer shaft 21. The hammer shaft 21, like the latch shaft 27, is secured to the grip piece side walls. The hammer 13 is biased by a pair percussion springs 25 (see FIGS. 4 and 5), which are disposed on the lateral sides of the hammer body 13*b* on shaft stubs. The springs 25 resemble clothespin springs and thrust the hammer 13, from the position shown in FIG. 1 to the forward position shown in FIGS. 2 and 3**.

The hammer 13 is preferably made of plastic having a steel inset 15 embedded therein. This provides the hammer 13 with the required mass to strike the firing pin 9 with the required striking force.

The hammer body portion **13*b* has a front or first stop notch 17 and a rear or second stop notch 19 disposed about its generally arcuate surface. The hammer 13 also has a depression formed between the steel inset 15 and the first stop notch 17 that generally defines the transition between the head portion 13*h* and the body portion 13*b***.

Figure 3:
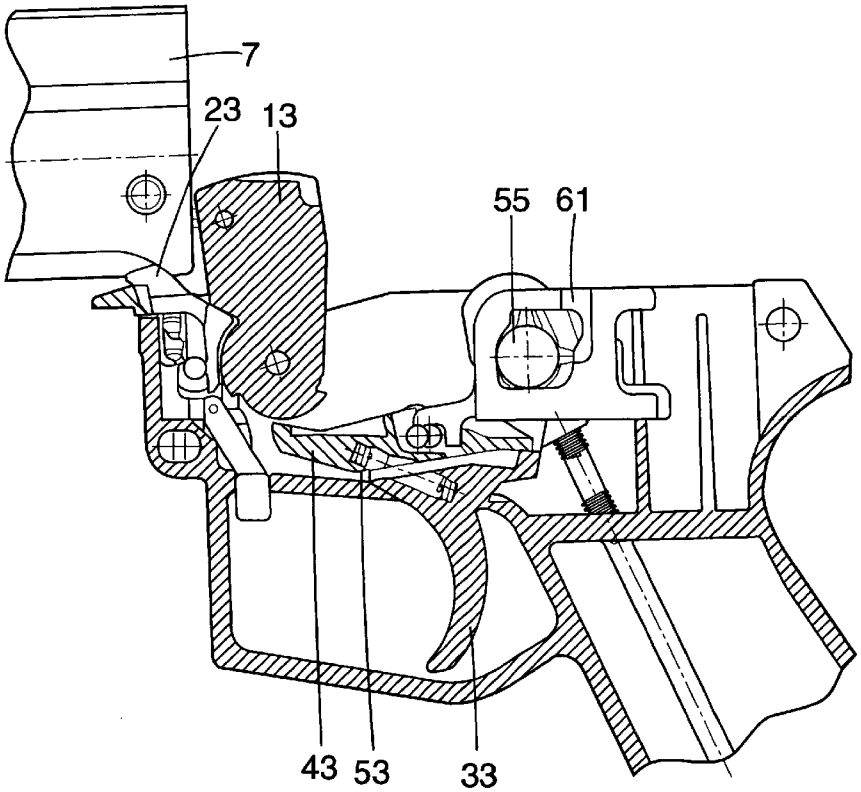
FIG. 3 is a longitudinal section illustrating the trigger arrangement in a continuous firing position.
Figure 2:
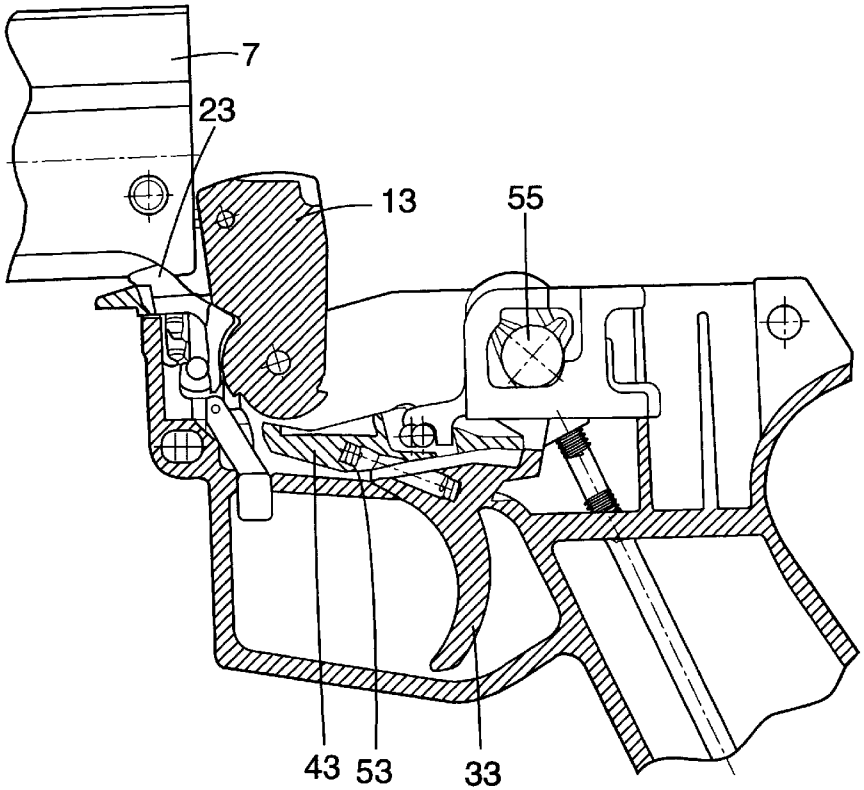
FIG. 2 is a longitudinal section of the trigger arrangement illustrated in a single shot firing position.

The hammer 13 can occupy a relaxed end position, which is shown in FIGS. 2 and FIG. 3. In this position, the hammer is upright and disposed directly behind the breechblock 7. In this position, the head **13*h* drives-in the firing pin 9. As shown, the latch 23 at this time is swung forward by the interrupter projection 11 of the breechblock 7**.

The hammer 13 is counter-rotated by movement of the breechblock 7 as it travels rearward until the hammer reaches its fully tensioned position, in which it lies approximately horizontal and allows the breechblock 7 to slide over it. When the breechblock 7 is in this position, the latch 23 is swung to the rear and lies on the outer circumference of the hammer 13 between the first stop notch 17 and the second stop notch 19.

When the breechblock 7 slides forward again, it again releases the hammer 13 which rotates slightly upward (counterclockwise in the drawing), until the latch-stop projection 29 engages the first stop notch and thus retains the hammer 13. When the breechblock 7 reaches the front end position shown in the figures, it presses its interrupter projection 11 against the latch finger protrusion 31 and swings this forward (counterclockwise in the drawing), so that the latch-stop projection 29 is pushed out of the first stop notch 17. This permits the hammer 13 to strike off.

If the weapon is in the continuous firing position (FIG. 3), then the striking-off of the hammer 13 is unobstructed up to the position shown in FIG. 3, where the follow-up cartridge (not shown) is ignited; its recoil and/or gas pressure then repeat the above-described recoil movement of the breechblock 7.

If the weapon is in the single-firing position (FIG. 2), then the hammer 13 moves forward only slightly to permit its second stop notch 19 to engage an ear 47 of a firing lever 43 described below.

A trigger 33 is rotatably mounted about a trigger axis 35 disposed rearward and beneath the hammer shaft 21. The grip piece 1 is traversed by a trigger axis 35 on which a trigger 33 is pivotally mounted. The trigger 33 is fabricated primarily of plastic. The trigger 33 has an actuating lever which passes downward through a slot formed in the grip piece casing 1. The trigger also has a main body recessed within the casing. A security projection 37 extends upward from the body.

The rear portion of the trigger body has a metal inlay which forms an engaging lug 39. The lug provides a support for a trigger spring (not shown). This trigger spring is also constructed as a dual-shank clothespin spring and is seated with its spiral section on a lateral shaft stub formed on the trigger 33 and supported with one of its shanks on the bottom of the casing. This trigger spring presses the trigger into the position of FIG. 1, in which it is ready to be activated.

In the recess there is accommodated an elongated firing lever 43 extending in the lengthwise direction of the weapon. The lever 43 has a cross-bore 45, which is received by the trigger axis 35. The cross-bore 45 is constructed as an oblong opening or slot so that the firing lever 43 can be rotated to some degree, relative to the trigger 33, and can move in the longitudinal direction. The firing lever 43 is primarily fabricated of plastic and has only a metal spur pointing rearward embedded into it. The rear portion of the firing lever 43 forms the free end 49 that transitions to a projection 51.

A blind bore is disposed between the firing lever 43 and the trigger 33 in which there is seated a spiral pressure spring 53. The spiral pressure spring 53 runs obliquely from beneath the trigger axis 35 to bias the firing lever 43 forward and upward relative to the trigger 33. The front portion of the firing lever 43 forms the engaging ear 47 mentioned above.

From the rest position of the trigger 33 and firing lever 43 shown in FIG. 1, the lever, under the pressure of the trigger spring, is located in its forward-most position. The hammer second stop notch 19 engages the engaging ear 47 and in the process, under the load of the two percussion springs (not shown), presses the firing lever 43, against the action of the firing spring 53, to the rear until the oblong slot 45 is seated with its front boundary on the trigger axis 35. The firing lever free end 49 is above, but not in contact with, the upper surface of the trigger engagement lug 39.

If the trigger 33 on the actuating lever is drawn to the rear for the delivery of a shot (in the position of FIG. 1 this is not possible because the safety is in operation, which will be described later), then the trigger 33 moves along a free swinging path, until the upper surface of the engagement lug 39 strikes against the firing lever rear end 49. It is at this point that the rifleman feels the "pressure point." If the trigger 33 is pulled back further, then the engagement lug 39 lifts the rear end 49 of the firing lever 43 and swings in about the trigger axis 35. With this swinging movement the engaging ear 47 is rotated downward until the second stop post 19 is freed, and the hammer 13 strikes off. Since the breechblock 7, present in the foremost position, holds the latch 23 forward (as already described above), the hammer 13 strikes against the back of firing pin 9 and releases the shot. The trigger 33 in the meantime is held fast in its position by a "Trigger-Stop" (which will be described later).

When the hammer 13 is in the struck position, the second stop notch 19 does not press the engaging ear 47 to the rear. The firing lever 43 is thus moved forward by the firing lever spring 53 until the rear end 49 of the firing lever 43 has been moved forward beyond the engagement lug 39. Now the firing lever 43 can be swung by the action of the firing lever spring 53 (clockwise in the drawing), which results in the rear end 49 of the firing lever 43 dropping in front of the engagement lug 39 of the trigger 33 into the recess 41. Simultaneously, the firing lever 43 is pressed upward on its front end (the engaging ear 47) until the ear 47 lies against the lower outer contour of the hammer 13 between the stop notches 17 and 19. This state, at the moment of ignition of the shot, is shown in FIG. 2.

If, upon recoil of the breechblock 7, the hammer 13 is again tensioned, then the second stop notch 19 traverses over the ear 47 pressed resiliently against the hammer 13 and snaps in behind it. When, because of the forward movement of the breechblock 7, the hammer 13 can again rotate a little forward, then the second stop notch 19, by its engagement into the ear 47, urges the firing lever 43 to the rear until it strikes with its rear end 49 against the front surface of the engagement lug 39.

If the trigger 33 is now released, it then counterrotates the engagement lug 39 downward, and the firing lever 43 is thrust rearward by the hammer 13, which moves slightly forward to the position shown in FIG. 1. By renewed actuating of the trigger 33, a shot can again be delivered; but because of the described functioning of hammer 13, trigger 33, and firing lever 43, it would always one be only one shot.

In accordance with the invention, an engaging element is disposed at an end of a pivot lever, with a projection at one end of the lever disposed to engage the firing lever. The engaging element does not shift the firing lever. When the weapon is tensioned and set for single firing, the engaging element only shifts it in its movement path, with a relatively small force required for its actuation. For example, it is contemplated that the engaging element be actuated by an electromagnet which, for example, shifts the weapon over automatically to continuous firing when a searchlight mounted on the weapon is turned on. Alternatively, the engaging elements shift the weapon over automatically to single firing when an optical-electronic precision sight arrangement is activated.

In the preferred embodiment, the engaging element is constructed as a slider piece that is mounted in the trigger arrangement without disturbing the functionality of other structures thereof. In particular, the slider piece is constructed as a transverse slider with a push-button on each of its ends. According to selection of the firing type (single or continuous firing), one of the ends overlaps a lateral side of the grip piece.

Preferably, the slider piece is coupled with the safety roller, and serves to secure the weapon and selecting the firing choice. In particular, a plastic firing-cessation shaft 55 traverses the grip piece 1 in the transverse direction. On the outside of the grip piece 1 there is formed on each end of the fire-cessation shaft 55 a safety and firing choice lever (not shown), by which certain rotary positions of the firing-cessation shaft 55 can be selected. Furthermore, the firing-cessation shaft 55 consists of two separate length sections which, by plugging together, can be firmly locked or clamped with one another.

Over the firing-cessation shaft 55 there is a plastic ring (not shown) which can only be rotated with the shaft 55 and which has along its outer circumference two adjacently lying rest depressions, into which a stop finger (stop body 67) is registered. The stop finger is pressed against the firing-cessation shaft by a stop spring 69.

The stop finger is formed on a stop body 67 which has an oval recess which surrounds the firing cessation shaft 55 and on the axis of which the stop finger lies, and extends from underneath into the recess. The stop body 67 has a spring guide rod for the stop spring 69 extending from the axis of the oval recess.

The plastic ring together with its three stop depressions establish three rotary positions of the firing-cessation shaft 55, namely the "Safe" position, the "Single firing" position, and the "Continuous firing" position. The plastic ring described, however, can also be interchanged with a plastic ring with only two stop depressions if the rifle is not to be designed for "Continuous firing." In this case, the slider piece 61 described below would also be omitted.

In FIG. 1 the firing cessation shaft 55 is represented in the "Safe" position. In this position, with the trigger 33 not activated, the safety projection 37 of the trigger 33 lies against the outer rim of the firing cessation shaft 55 or is located just beneath this rim. If the trigger 33 is pulled, it will not swivel or will swivel only inconsequentially.

The firing cessation shaft 55 has a safety recess 57. If the firing cessation shaft 55 is in the rotary position "Single firing" (FIG. 2) or "Continuous firing" (FIG. 3), then this safety recess 57 faces the safety projection 37 of the trigger 33, and the trigger can be swiveled until the safety projection 37 strikes against the bottom of the safety recess 57. This impact forms the "Trigger-Stop." Alternatively, a shortened safety projection 37 can include an adjustable screw accessible from underneath which strikes against the bottom of the safety recess 57 and serves as the fine adjustment of the "Trigger-Stop."

Furthermore, the firing-cessation shaft 55 has, in addition, two cam surfaces 59 offset by about 90° to one another, which overlie the outer circumferential surface of the firing-cessation shaft 55. The cam surfaces 59 engage into the opening 65 of plastic slider piece 61 which is closed on all sides and reinforced with sheet metal.

In order not to impair other functional elements of the trigger arrangement, the slider piece can act on the cam surface of the roller only from one side. Preferably, it surrounds the roller, which passes through a breakthrough formed in the slider piece so that between the cam arrangement of the roller and the slider there is created an extremely stable, dependable connection. This makes it possible for the slider to be very narrow in its transverse dimension so that it does not obstruct other functioning elements, and to contribute little to the total weight of the weapon.

Insofar as the slider piece fully surrounds the roller and impinges into the pivot path of the hammer, it is necessary to recess the rear side of the hammer correspondingly. Because the slider is narrow, the recess of the hammer can be narrow as well, thus its weight is hardly decreased and its functional capability is not impaired.

In the preferred implementation, the slider piece 61 is approximately planar and it has, opposite the opening 65, a metal section protruding forward from which there is a downward protruding finger 63. The slider piece 61 also has an extension on the back side with respect to the opening 65.

The back extension of slider 61 is guided in a slot formed in a cross-wall of the grip piece 1. The forward-protruding metal plate section rests on the trigger axis 35, the finger 63 being arranged to be located in the space between the trigger axis and the firing lever projection 51. Furthermore, the inner rim of the opening 65 lies against the outer rim of the firing cessation shaft 55 and the ends of its cams 59 in such a way that the slider 61 is always retentively held in its particular position regardless of the rotary position of the firing cessation shaft 55.

As is evident from the figures, the opening 65 and the cams 59 are constructed in such manner that the slider 61, both in the "Safe" position of the firing cessation shaft 55 (FIG. 1) and in the "single firing" position, occupies a front position in which the finger 63 abuts the trigger axis 35 from behind. There it does not obstruct the forward movement of the trigger lever 43 required in each interruption process.

If the firing cessation shaft 55, however, is rotated from the "continuous firing" position (FIG. 2) to the "continuous firing" position, then the cams 59 engage into the opening 65 and move the slider 61 to the rear so that the projection finger 63 abuts the lever projection 51. The rotating movement of the firing lever 43 in actuating the trigger 33 for the release of a shot is not obstructed in the process.

If the trigger 33 is actuated, the firing lever 43, with its rear portion 49 disposed in front of the engagement lug, cannot be moved since it is obstructed in any forward movement by the projecting finger 63 of the slider piece 61 abutting the projection 51. The lever rear end 49, therefore, remains on the engagement lug 39. Hence, the firing lever 43 remains in its tilted position and cannot be rotated to engage the second stop notch 19 of the hammer 13.

The hammer 13, after the tensioning, is held only by the latch 23, and only until this is swung away by the interrupter projection 11 of the hammer 13. The rifle fires, therefore, as long as the trigger 33 remains actuated.

As noted above, in order to provide a compact structure, where the spacing between the hammer shaft 21 and the firing-cessation shaft 55 is as small as possible, the hammer 13 is provided with a recess for receiving the outer front edge of the break-through 65 of the slider 61.

Figure 5:
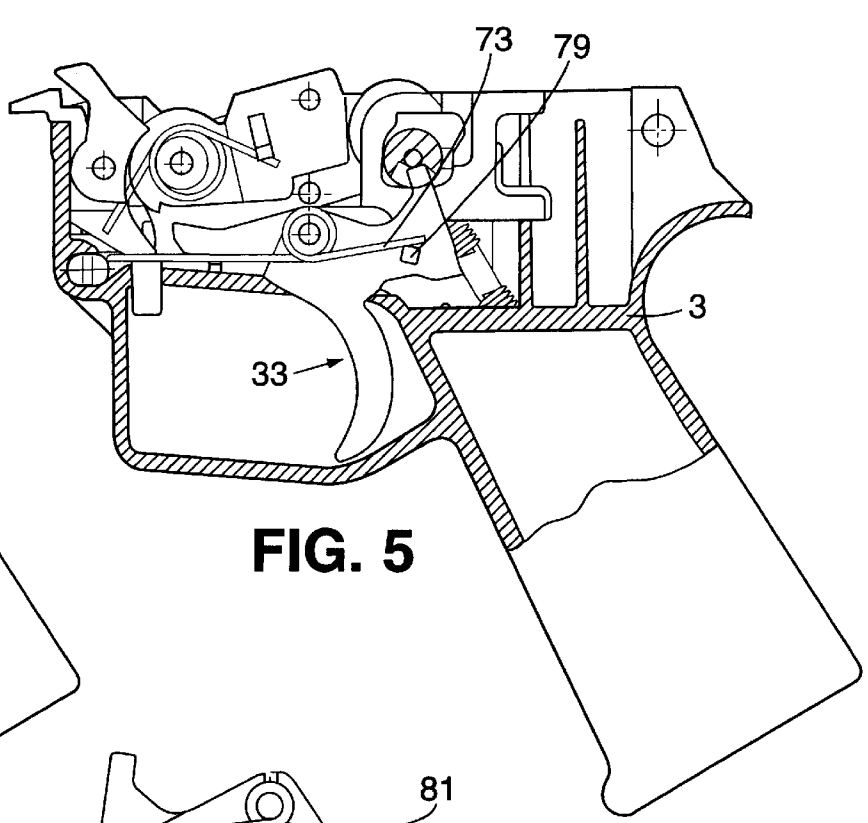
FIG. 5 is another section view of the embodiment shown in FIG. 4.
Figure 4:
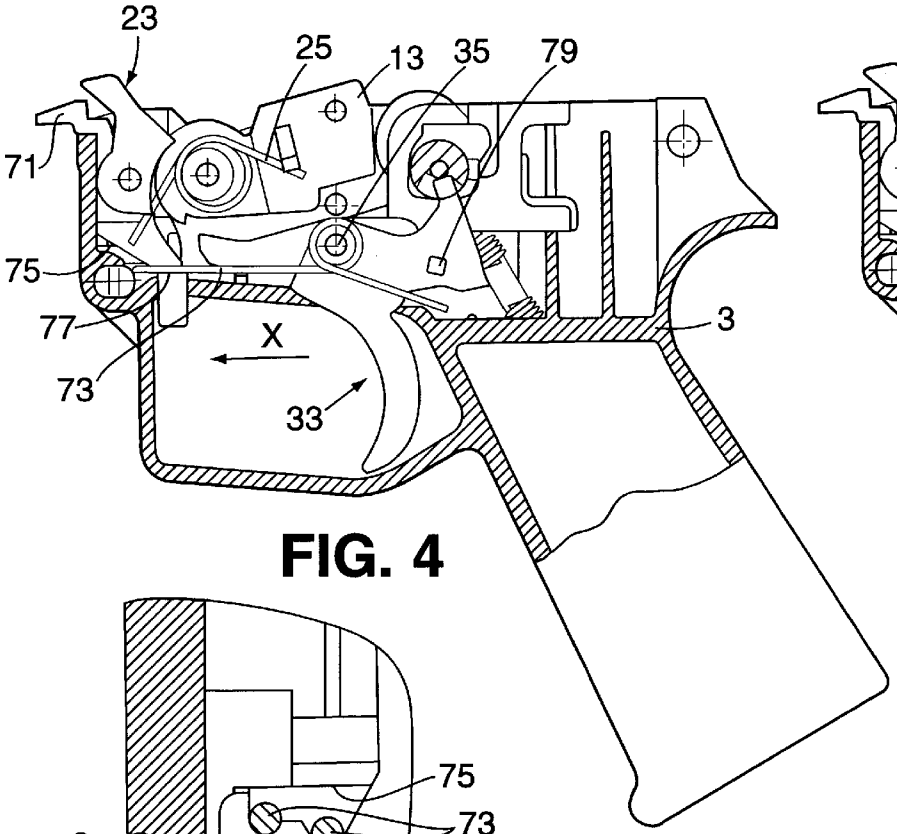
FIG. 4 is a partial longitudinal section of another embodiment of the trigger arrangement of the invention.

FIGS. 4 and 5 show an alternative embodiment wherein only the grip piece 3 and firing cessation shaft 55 are shown in a longitudinal cross-section; all the other parts are represented in plan view. The embodiment represented in FIGS. 4 to 6 has all the features of the embodiment of FIGS. 1 to 3. Thus, only those features which are described and emphasized in the drawings with reference numbers are not represented in the preceding figures. Otherwise, the variants present additional features which are described further below and are marked with reference numbers in the drawings.

Figure 6:
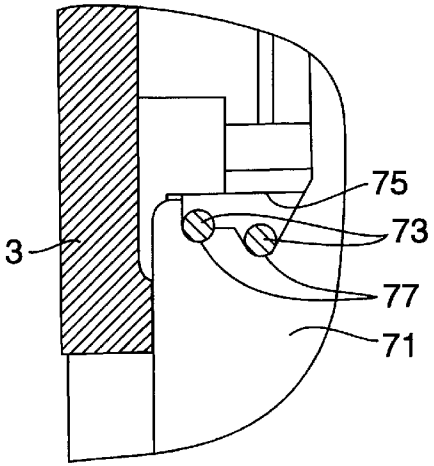
FIG. 6 is a section taken in the direction of the arrow in FIG. 4.

The trigger arrangement of FIGS. 4 to 6 is shown in the continuous firing position between two successive shots. The trigger 33 is pulled to the rear and the hammer 13 is held in a tensioned position by the engagement of the latch 23 into the first stop notch 17, which is the position shortly before the end of travel position of the hammer 13.

In FIGS. 4 and 5 one of the two percussion springs 25 is shown. As noted above, the springs have a wound section in the middle from which two shanks extend, and which is seated loosely on a shaft butt of the hammer 13. One of the two shank ends engages a counter-bearing located on the hammer 13 to urge the hammer 13 in the strike-off direction. The other shank end engages a downwardly directed projection of the latch and forces this in such manner that it is pressed, with its latch-stop projection 29, against the hammer 13.

With this arrangement, not only is a separate latch spring unnecessary, but the force with which the latch 23 is pressed against the hammer 13 is dependent on the position of the hammer 13. This becomes especially great when the latch 23 is to engage dependably into the first stop notch 17, within an extremely short amount of time. If, for example, in continuous firing, this engagement should erroneously fail to be made, then the follow-up cartridge is not ignited and the weapon, just when it should fire, would have to be loaded.

In the embodiment shown, the percussion spring 25 always provides a sufficiently powerful force on the latch 23 when it must fall in. If, however, the weapon with the trigger arrangement is not in use but is in storage, then the hammer 13 is not tensioned and the force of the percussion spring on the latch 23 is correspondingly slight. All the involved components of the weapon are exposed, at most, only to weak forces.

In the grip pieces 3 of the embodiments shown, there is also present a breechblock-catching piece 71 (indicated with reference number only in FIGS. 4 and 6). The breechblock-catching piece retains the breechblock 7 (FIGS. 2 and 3) open, after firing off the last shot. In this way, the rifleman is made aware that the weapon is out of ammunition. After a full magazine is loaded, the loading lever is retracted and let go, the weapon is then again ready to fire. It is not necessary, for the loading lever to be drawn back over its entire range of movement.

The breechblock catching piece 71 has, on its upper side, a forward-pointing finger which is moved upward by a magazine follower (not shown) after removal of the last cartridge. An upward point catching projection extends into the movement path of the breechblock 7 and prevents it from moving again into its foremost position once it has been thrown back after the firing of the last cartridge. Further, the breechblock-catching piece 71 has an extension protruding downwardly from the grip piece, which serves as handle in order to press the breechblock catching piece 71 upward. With the magazine removed, this handle is able to hold the breechblock 7 open for the inspection of the barrel without disassembling of the weapon.

In the embodiment shown in FIGS. 1–3, the breechblock-catching piece has a spring 25 which is seated in the front side of the grip piece to urge the breechblock-catching piece downward to prevent it from inadvertently holding up the breechblock.

In the embodiments of FIGS. 4–6, a spring 73 is provided with a front spring arm which acts on the breechblock-catching piece 71. This spring 73, like the percussion spring 25, is constructed as a clothespin spring, with a wound section from which two shanks, lying approximately opposite one another, project. The wound section is seated on a shaft butt of the trigger 33 or on a sleeve which is slid onto the trigger axis 35. Of course, there is some play present which permits the slight unobstructed movement of the trigger.

The front shank of the spring 73 is seated on a spring receiver 77 which is formed on the breechblock-catching piece 71 and applies a downward force. This shank of the spring 73 is extended forward over the breechblock-catching piece 71 and has its end located beneath a projection 75 formed on the grip piece 3.

As is seen in FIG. 6, the spring receiver in the breechblock-catching piece 71 is constructed with two recesses 77. The first recess is closer to the horizontal extension of the lower surface of the projection 75. The second recess is further away. The distance from the horizontal extension corresponds, at least, to the range of motion of the breechblock-catching piece. Between the two recesses there is a section the distance of which from the horizontal extension mentioned above must be greater than the thickness of the spring shank.

If the shank of the spring 73 is seated in the recession further from the horizontal extension (in FIG. 6 the right side), then the functioning of the breechblock-catching piece 71 occurs unobstructed, as it is described above.

In many other uses, however, a breechblock barrier formed by the breechblock-catching piece 71 is undesired because, for example, mud or sand could pass into the interior of the weapon housing if the breechblock remains open. In this case, with the aid of a thin screwdriver or a knife tip, the shank end of the spring 73 is moved from the right side recess in FIG. 6 and located into the corresponding deeper recess (left side). Now the breechblock catching piece 71 can no longer move upward, because the end of the spring shank prevents upward movement of projection 75, and also breechblock-catching piece 71.

The shift between an active and inactive breechblock barrier is brought about by the sliding back and forth of the spring shank between the two recesses. This can be performed by the ordinary mechanic of the unit, for example. Of course a weapon can also be delivered with the adjustment made at the time of manufacturing.

As is known, the accuracy of the marksman increases the "softer" the trigger is (i.e., the lesser the force is that has to be applied for its movement to the rear). This force, which must also overcome the restoring force of the trigger spring, should be as small as the handling and functional security of the weapon permit. An inadvertent, light touching of the trigger or a usual force which acts on the trigger must not fire the weapon. The trigger spring must also be capable, under normal environmental conditions, to always dependably return the trigger to its foremost position.

Under unfriendly environmental conditions (severe frost which allows grease or oil to harden in the weapon, severe fouling by fine sand, etc.) the restoring force of the trigger spring is sometimes no longer sufficient if the spring is designed for a soft trigger. For this reason the trigger springs of military hand firearms have been designed in such manner that their restoring force is still sufficient even under the severe conditions described. This however, reduces the accuracy of the marksman.

In the embodiment of FIGS. 4 through 6, the trigger weight or the restoring force may be selected according to the environmental conditions to be expected or according to the experience of the user.

Figure 7:
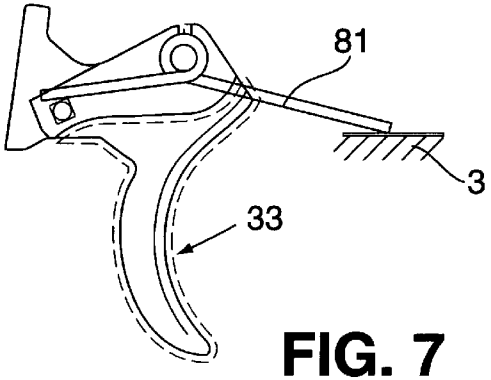
FIG. 7 is an enlarged schematic side view of the trigger arrangement of the present invention showing the trigger and trigger spring.

The trigger arrangement 81 (see FIG. 7) has a trigger spring which, in FIGS. 1–5, is covered by the trigger. It corresponds to the state of the art and is laid out in such manner that the trigger is "soft". In fact, the restoring force of the trigger spring can be extremely light, because the trigger consists of comparatively light material (plastic), so that the mass forces against which the restoring force must act are slight.

In the operating state shown in FIG. 4, the rear shank of the spring 73 rests on the inside of the grip piece 3. The spring 73 lying in this position provides the restoring force, which urges the trigger forward. Thus, the trigger is "soft". This operating state is chosen when favorable environmental conditions are to be expected, or when experienced persons are to use the weapon.

A spring support 79 is located proximate to the rear shank of the spring 73 on the side surface of the portion of the trigger which extends to the safety projection 37. The rear shank of the spring 73 can be deflected upward under force-storing deformation of the spring 73, and be placed on the spring support. This shifting-over can be performed simply, for example, by gripping from above, under the spring shank, with a hook and raising it. Now the spring 73 reinforces the restoring force of the trigger spring (not shown) and the trigger becomes "hard".

This position of the spring shank is shown in FIG. 5. This setting will be chosen in unfavorable environmental conditions, or when the weapon is issued to an inexperienced person, from which there cannot yet be expected a safe handling of the weapon. The desired adjustment can, of course, be made at the factory.

The two adjustments described above (effectiveness of the breechblock barrier and the restoring force acting on the trigger 33) can be made in an extremely short amount of time by an instructed person with the simplest tool. The user of the rifle, however, is not in a position to do this, since there is no handle or anything with which the user might make an adjustment. The rifle is, therefore, always in the adjustment state in which it was issued.

The disengageable breechblock locking described or the switching-on at will of an additional restoring force on the trigger can be performed in common or separately on a weapon which is not equipped with the trigger arrangement according to the invention.

Various advantages flow readily from the invention. For example, in known trigger arrangements, the spring arrangement acting on the firing lever is formed from two springs, of which one swings the firing lever with the extension to the hammer, and the other pushes the firing lever forward. This arrangement is necessary because of the relatively long swing path that the firing lever, together with the trigger, must cover. In addition, after the releasing of a shot in continuous firing position, further swinging of the trigger should not be prevented. By contrast, in the invention, the swing path of the firing lever is substantially reduced so that the spring arrangement can now be formed only by a single pressure spring, which is active between the trigger underneath its pivot axis and the firing lever in front of this pivot axis. This pressure spring not only forms a constructive simplification, but it is also less exposed than the known spring arrangement, so that the risk of fouling, which could lead to a malfunction, is clearly reduced. The pressure spring presses the firing lever forward and, with the extension, upward.

In addition, the trigger, the latch, the fire cessation roller, and the slider are preferably formed of plastic having metal inlays embedded therein as required. That is, a metal impact body can be embedded into the hammer to increase the mass. Similarly, an insert seated on the engagement lug can be embedded into the firing lever as well as a plate into the slider piece to reinforce the engagement zones and provide increased stiffness. Similarly, the casing that houses the trigger arrangement is formed from plastic rather than steel sheeting. This enables the casing to be molded as the upper section of the grip piece in a unitary construction.

This construction is especially economical, as well as being exceptionally light and corrosion-resistant. Since plastic is pliable to a degree, the axes and shafts can be located into respective bores with a low insertion force, and are firmly and sealingly retained by a resilient material. Thus, it is not necessary, as was the case with pass bores in constructions of the prior art, to maintain close tolerances. Likewise, such bores do not wear out after extended periods of use. The invention thus yields an economically manufacturable, corrosion-resistant, and lightweight grip piece which requires little care and which is suited not only for the trigger arrangement of the invention, but for other trigger arrangements as well.

Accordingly, a trigger arrangement meeting the aforestated objectives has been described. The invention provides ready transition between a single-shot mode and an automatic firing mode with a shift-over mechanism that simplifies production costs, while being reliable in operation. It should be understood that the invention is not limited to the specific embodiments or structures described herein. Rather, it is intended that other constructions and equivalents be included as would be understood by those skilled in the art, particularly upon consideration of the foregoing teachings.

What is claimed is:

1. A trigger arrangement in an automatic weapon operable in either a single-shot mode or a continuous-firing mode, comprising:

a hammer including a first stop and a second stop, and a percussion spring operably connected to the hammer permitting movement from a fully tensioned position to a relaxed position;

a movable breechblock disposed to permit movement of the hammer from the relaxed position into the fully tensioned position;

a releasing arrangement, controlled by the breechblock, and cooperating with the first stop of the hammer in the continuous firing mode;

a pivotably mounted trigger having an engagement lug disposed at one end, the trigger being biased by a trigger spring to a rest position, and being actuatable, against the action of the trigger spring, from the rest position into a depressed position;

a firing lever mounted about an axis of rotation, having one end disposed to engage the second stop of the hammer, and an opposed end disposed to engage the trigger engagement lug in the single-shot firing mode, the lever being swingably and slidably retained by a lever spring arrangement operable to rotate the lever into re-engagement with the second stop after the trigger is actuated; and a shift-over arrangement operable to move the weapon between the single-shot mode and the continuous-firing mode, the shift-over arrangement including an engagement element for engaging the firing lever to restrict movement thereof to prevent engagement of the firing lever with the second stop notch in the continuous-firing mode.

2. The invention as in claim 1 wherein the lever spring arrangement is formed by a single pressure spring obliquely disposed between the firing lever and the trigger.

3. The invention as in claim 1, wherein the engagement element comprises a slider piece having an end disposed proximate to the firing lever.

4. The invention as in claim 3 further comprising a firing cessation roller having at least one cam surface, the roller extending substantially parallel to the pivot axis of the hammer, the slider piece engaging the firing cessation roller cam surface to place the weapon in the continuous firing mode upon rotation of the roller.

5. The invention as in claim 4 wherein the firing cessation roller is provided as a safety element.

6. The invention as in claim 4 wherein the slider piece includes an opening which is sized to receive the firing cessation roller cam surface.

7. The invention as in claim 4 wherein the firing cessation roller is fabricated of plastic.

8. The invention as in claim 3 wherein the slider piece comprises a plastic portion having a metal plate located therein to provide support and an engagement surface.

9. The invention as in claim 1 wherein the hammer, the firing lever, and the trigger consist of at least 50 percent plastic.

10. The invention as in claim 9 wherein the hammer includes a percussion body fabricated of metal and wherein the opposed end of the firing lever includes an embedded metal piece.

11. The invention as in claim 1 wherein the trigger arrangement is mounted in a case equipped with a grip piece, and wherein the case and the grip piece are formed as a unitary plastic part.

12. The invention as in claim 11 wherein the percussion spring is formed from a pair of wire-shank springs, each with a winding-form section and two opposed shanks, each winding-form section in surrounding relation to a hammer shaft with one shank supported by a portion of the hammer and the other shank being supported by a portion of the grip piece.

13. The invention as in claim 1 wherein the releasing arrangement comprises a spring-biased engagement member, and wherein the hammer includes the percussion spring which engages one end in the hammer and the other end is supported with a spring-loading effect on the engagement member.

14. The invention as in claim 1 further comprising a spring-burdened breechblock-catching piece operatively engaging the breechblock, the catching piece being slidable from a rest position in which the breechblock is freed to a working position wherein the breechblock is retained in an open position; and an adjustable blocking mechanism disposed to selectively retain the breechblock-catching piece in the rest position.

15. The invention as in claim 1 further comprising a spring engageable with the trigger to bias the trigger in the same direction as the trigger spring.

16. The invention as in claim 15 wherein the spring which is engageable with the trigger has a shank which is engageable in a spring receptacle that is formed on the trigger.

17. The invention as in claim 16 wherein the shank of the spring which is engageable with the trigger is supported, in the released state, on a grip piece.

18. The invention as in claim 17 wherein the spring which is engageable with the trigger is constructed as a spring having first and second opposed shanks, the first shank acting on a breechblock-catching piece and the second shank being movable into or out of engagement with the spring receptacle.

19. The invention as in claim 17 wherein the spring which is engageable with the trigger is constructed as a wire spring, with a wound section seated on the trigger axis, from which first and second opposed shanks protrude.

* * * * *